US005413288A

United States Patent [19]

Inui et al.

[11] Patent Number: 5,413,288

[45] Date of Patent: May 9, 1995

[54] COMPOUND PARTITION DIAPHRAGM FOR USE IN A BALL MILL

[75] Inventors: Yasuo Inui; Nobuhito Yagi, both of Osaka, Japan

[73] Assignee: Kurimoto, Ltd., Osaka, Japan

[21] Appl. No.: 91,743

[22] Filed: Jul. 15, 1993

Related U.S. Application Data

[63] Continuation of Ser. No. 726,960, Jul. 8, 1991, abandoned.

[30] Foreign Application Priority Data

Mar. 29, 1991 [JP] Japan ..... 3-093203

[51] Int. Cl.[6] ..... B02C 17/07

[52] U.S. Cl. ..... 241/72; 241/171; 209/400; 209/401

[58] Field of Search ..... 241/71, 70, 72, 171; 209/400, 401, 361, 381, 395

[56] References Cited

U.S. PATENT DOCUMENTS

| | | | |
|---|---|---|---|
| 1,770,977 | 7/1930 | Fowden | 209/395 |
| 3,483,974 | 12/1969 | Pearsall | 209/395 |
| 4,256,264 | 3/1981 | Hansen et al. | 241/72 |
| 4,369,926 | 1/1983 | Rasmussen et al. | 241/18 |
| 4,904,378 | 2/1990 | Arai | 209/400 |
| 5,221,008 | 6/1993 | Derrick, Jr. et al. | 209/269 |
| 5,292,077 | 3/1994 | Inui et al. | 241/72 |

FOREIGN PATENT DOCUMENTS

| | | | |
|---|---|---|---|
| 1025446 | 6/1983 | U.S.S.R. | 241/72 |
| 1333410 | 8/1987 | U.S.S.R. | 241/171 |

*Primary Examiner*—John Husar

*Attorney, Agent, or Firm*—Jones, Tullar & Cooper

[57] ABSTRACT

A partition diaphragm which divides a grinding chamber of a ball mill into several chambers is formed into a compound structure comprising a primary screen plate and a secondary screen plate, with the slit clearance of the secondary screen plate being smaller than that of the prior art while avoiding the occurrence of blinding. The secondary screen plate of the partition diaphragm is comprised of a wire sieve provided with fine slits having a trapezoidal shape in section. The wire seive is loosely disposed between adjacent members so as to be freely movable to a certain extent. Since there is no sticking of material by movement of the wire sieve in spite of the slit clearance in the wire sieve, fine particles in the partition diaphragm can move smoothly and the two grinding chambers are well-balanced, resulting in an improved grinding efficiency.

2 Claims, 3 Drawing Sheets

COMPOUND PARTITION DIAPHRAGM FOR USE IN A BALL MILL

This is a continuation of application Ser. No. 07/726,960 filed on Jul. 8, 1991 now abandoned.

BACKGROUND OF THE INVENTION

1. Field of the Invention

The present invention relates to a ball mill for grinding materials such as cement clinker and, more particularly, to a partition diaphragm for use in a ball mill, the partition diaphragm being formed inside a body of the mill and having multi-grinding chambers.

2. Prior Arts

Generally, plural grinding chambers, i.e., multi-grinding chambers are provided in a ball mill for the purpose of improving productivity while reducing energy cost per material thereby improving grinding efficiency as a whole, and in which a series of grinding processes are performed comprising the steps of primarily grinding a bulky material using a ball of large diameter (serving as a grinding medium) in a primary grinding chamber; filtering the material ground to a certain grain size; feeding the filtered material to a secondary grinding chamber; and grinding the fed material finely.

For that purpose, the partition diaphragm placed between one grinding chamber and the other performs a filtering action through a screen plate which is stretched over the partition diaphragm and permits only materials ground to a cetain grain size to pass through. In this filtering, if only one screen plate is employed, it is essential that this screen plate is resistant to the impact of the ball in the grinding chamber and that the clearance of the slits provided in the screen plate be about 4 mm. From the viewpoint of casting technique, it is not always easy to secure such a small clearance, and moreover if trying to secure a certain thickness considering sufficient resistance to the impact, there arise further disadvantages such as deflection or blinding of the slits.

Several partition diaphragm have been developed and proposed to solve the mentioned disadvantages as disclosed in Japanese Laid-Open Publication (unexamined) No. 54-127060, the contents of which were further improved and disclosed in Japanese Patent Publication (examined) No. 60-8867. In this improved proposal, a primary screen plate of a partition diaphragm facing primary grinding chamber is formed of a relatively thick member provided with slits each having 20 mm in clearance so as to be resistant to dynamic contact with a ball of large diameter and secure void area. On the other hand, a secondary screen plate disposed in parallel to the mentioned primary screen plate with a rib therebetween is provided with slits each having 6 mm in clearance. Thus, a connecting chamber for communicating with the entire circumferential direction is formed by the mentioned two screen plates. The secondary screen plate can be formed to be relatively thin because this screen plate is not put in contact with the ball. Furthermore, the secondary screen plate can be provided with a large number of punched small holes in view of ventilation.

In the actual operation of the ball mill, it is an essential requirement to balance the level of material in the primary grinding chamber with the level of material in the secondary grinding chamber. In case of the mentioned prior art, the partition diaphragm is formed into a double structure, in which the slit clearance of the primary screen plate is 20 mm and that of the secondary screen plate is 6 mm. As a result of such an arrangement, the problem pertinent to the partition diaphragm comprised of only one screen plate having a slit clearance of 6 mm in clearance of slits are certainly solved, but from the viewpoint of practical operation, it is not always optimum to establish the grain size of the material passing from the primary grinding chamber to the secondary grinding chamber to be smaller than 6 mm in diameter. To be more specific, when carefully observed, it is found that the amount of material fed from the primary grinding chamber to the secondary grinding chamber passing through the filtering slits is excessive over the grinding capacity of the secondary grinding chamber, and that a number of relatively large size (approximately 6 mm) grains are mixed and left in the material fed to the secondary grinding chamber and discharged therefrom as they are without further grinding, which results in the application of a further load to the secondary grinding chamber. Such a disadvantage can be obviously recognized by checking the lowest level of the material presented in a vertical section of the first and second grinding chambers as shown in FIG. 5. That is, referring to FIG. 5, the level of the moving material immediately before the partition diaphragm of the primary grinding chamber is largely lowered, thereby the grinding efficiency at such a portion is also largely lowered. This negative influence is carried over to the next secondary grinding chamber, and such unbalanced movement of the material will eventually bring about a decline in the grinding performance of the entire ball mill. Such an essential problem as mentioned above still remains unsolved and has not been overcome by the mentioned proposal of a mere double structure of a partition diaphragm.

It may be an obvious improvement to establish a slit clearance of the secondary screen plate to be smaller than 6 mm. It is, however, not always easy to manufacture by casting a screen plate the slit clearance of which is smaller than 4 mm. Under the present state of casting technique, disadvantages such as blinding, deflection occur easily and it will be an excessive demand beyond the state of the art in casting to establish and maintain a constant slit clearance smaller than 4 mm. It is certainly possible to provide by punching an iron plate with a large number of circular holes the diameter of which is smaller than 4 mm. But in the case of such punched holes, being quite different from the screen plate manufactured by casting, there remain sharp edges on the punched holes. And it may be sometimes the case that grains of material are caught by such sharp edges and sticked thereto resulting in blinding of the holes thereby causing the operation of the entire plant to stop. This kind of problem occurs easily when the hole size (i.e., hole diameter) is smaller, and the stuck material may bring about corrosion of the screen plate which, in turn, needs troublesome works such as disassembly or replacement of the partition diaphragm. Frequent occurrence of such operation stoppage has a grave influence not only on the grinding process but also on the production activities of the entire cement plant as a matter of course.

SUMMARY OF THE INVENTION

The present invention overcomes the above-discussed problems and has as an object the provision of a novel compound partition diaphragm for use in a ball mill which is capable of balancing respective grinding operations in multi-grinding chambers.

In order to accomplish the foregoing object, the compound partition diaphragm in accordance with the present invention comprises a wire sieve serving as a secondary screen plate which is regularly provided with fine slits of trapezoidal shape in section, the wire sieve being loosely disposed so as to be slightly movable.

In the compound partition diaphragm of the above arrangement, since the slit clearance of the primary screen plate facing the primary grinding chamber is as large as that of the prior art, material which has been ground to a certain grain size by passing through the slits of the primary screen plate moves into a connecting chamber.

Then, only the material the grain size of which is smaller than the slit clearance of the wire sieve can move into the secondary grinding chamber by passing through the slits of the wire sieve, while the material grain size of which is larger than the meshes of the wire sieve are fed back to the primary grinding chamber.

It is to be noted that since the wire sieve is provided with fine slits of trapezoidal shape in section, it is now possible to establish a slit clearance to be far smaller than that of the prior art, i.e., to be 2 mm or so. Further, since the section of each slit is invertedly tapered, there is less possibility of the problem of blinding due to the grains of material caught by the sharp edges to occur. In actual operation, since a wire sieve is loosely disposed, the wire sieve can shake itself in the axial or circumferential direction according to the rotation of the ball mill, and therefore even though part of the material sticks to the slits, the stuck material can be taken off almost completely during one rotation of the ball mill.

As a result, well-balanced flow of material can be smoothly achieved the without the occurrence of blinding in spite of a wire sieve having a fine slit clearance.

FIG. 1 is a schematic view showing the concept of a ball mill, and in which material supplied from the left side of the drawing enters the primary grinding chamber 1 and is subject to primary grinding during rotation together with the rotation of the ball mill of large diameter, and only the material ground to a certain grain size moves into the secondary grinding chamber 4 passing through the partition diaphragm 2. In the secondary grinding chamber 4, the material is finely ground with a ball of small diameter and discharged as final products from the right side of the drawing.

It is to be noted that, in each grinding chamber, the level of material is inclined very little as compared with the prior art illustrated in FIG. 5, and that amount of material to be ground which is located immediately before the partition diaphragm is sufficiently retained in the same manner as the other portion being different from the prior art.

Consequently, the slit clearance of slits of the wire sieve can be smaller than the prior art, and since there arises no disadvantage of the sticking of material to the slits and blinding thereof, only the material primarily ground to a certain grain size can be constantly fed to the secondary grinding chamber, whereby the grinding performance of the secondary grinding chamber is fully utilized and the flow of material throughout the entire mill is well-balanced, eventually resulting in remarkable improvement in grinding efficiency or productivity.

When this compound partition diaphragm is provided with a device for regulating the rate of flow from a diaphragm chamber to the primary grinding chamber to be used in combination, a further delicate regulation for achieving a well-balanced state of material flow can be performed. In such an embodiment, even if any condition predeterminedly set to be optimun has changed to a condition not optimum due to variation in the property of the material, it is easily possible to reset the condition to be optimum following such change.

Referring to an example of an advantage of the mentioned use in combination with a flow rate regulator, a test mill of 750 mm in diameter and 2750 mm in length presented a result of reducing power consumption by more than 15% as compared with the prior art, which is a remarkable energy saving. A still further advantage is achieved such that material is prevented from excessive grinding as a result of a smooth and well-balanced advance in material feeding, thereby a product of good quality without wide variation in grain size can be obtained.

Other objects and advantages of the present invention will become apparent in the course of the following description of the preferred embodiment with reference to the accompanying drawings.

BRIEF DESCRIPTION OF THE DRAWINGS

In the drawings forming a part of the present application.

DESCRIPTION OF THE PREFERRED EMBODIMENT

Figure 2A:
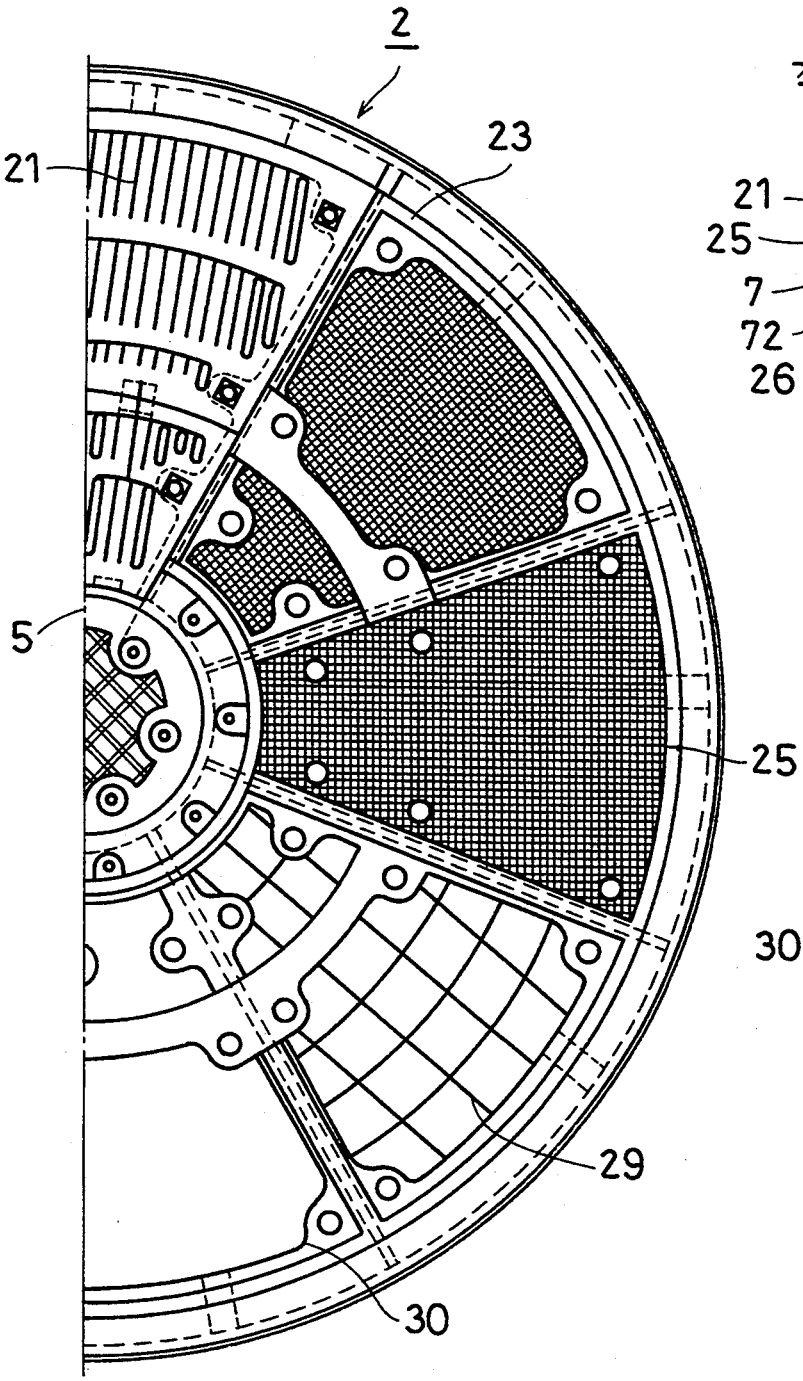
FIGS. 2(A) and 2(B) are a front view and a side sectional view respectively showing an embodiment of the present invention.
Figure 2B:
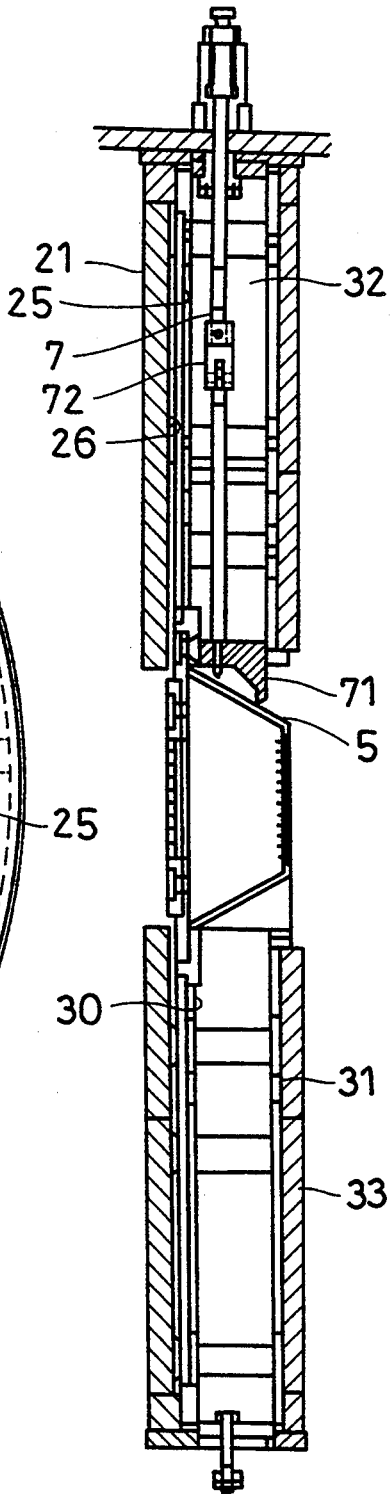
Figure 3:
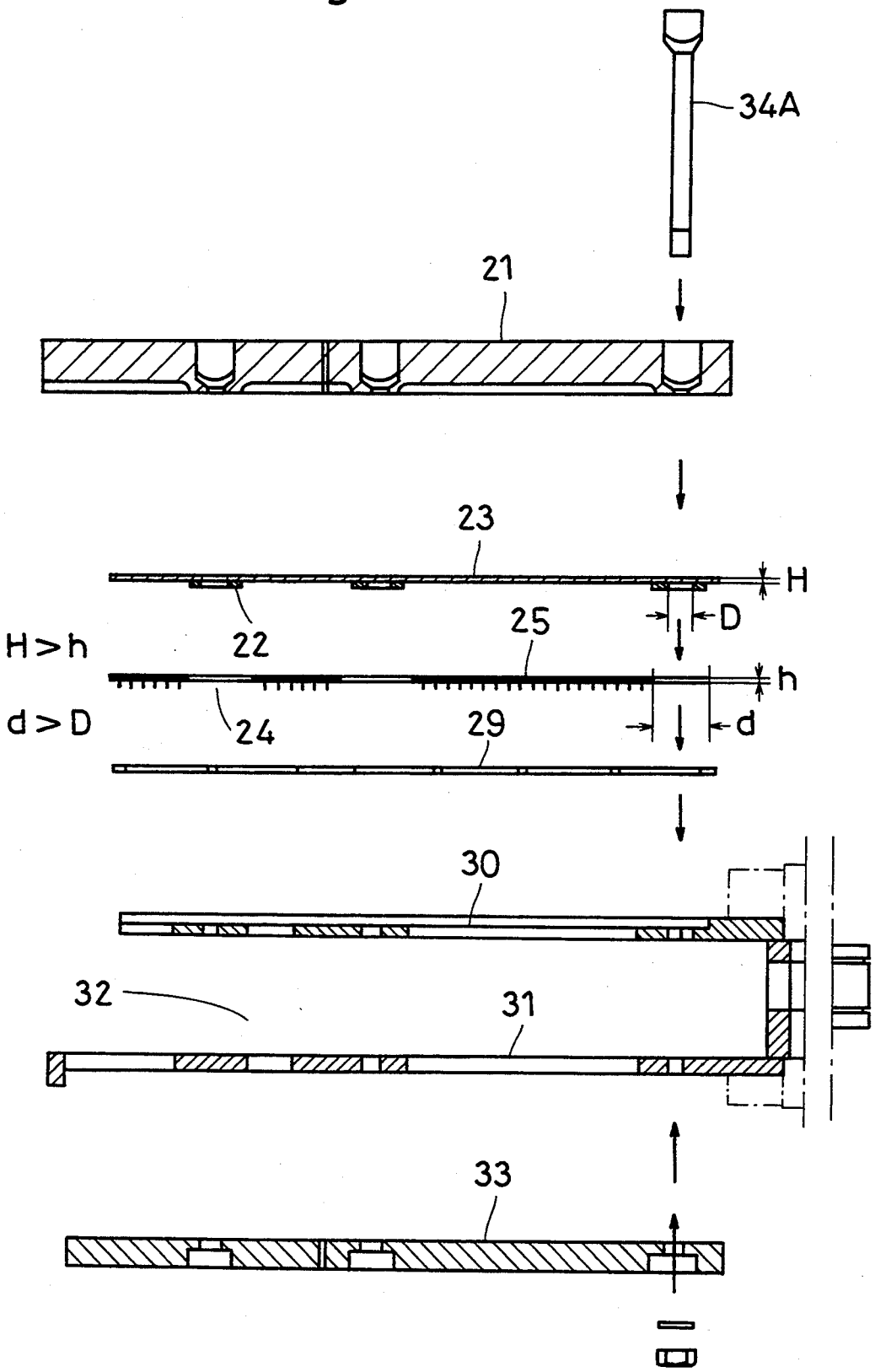
FIG. 3 is an exploded side view showing an assembling procedure of the embodiment.

FIGS. 2(A) is a front view showing a partition diaphragm 2 and FIG. 2(B) is a side sectional view thereof. FIG. 3 is an exploded side view showing components and parts to be assembled.

The partition diaphram 2 is provided across the body of a ball mill and divided into several divisions each spreading radially from a center cone 5. For convenience of explanation, FIG. 2(A) shows a partition diaphram 2 which is comprised of several members superposed one by one, and in which each of the divided fan-shaped divisions represents different phases of the partition diaphragm supposing that the superposed members are stripped off one by one in order.

In the partition diaphragm 2, a primary screen plate 21 faces a primary grinding chamber, and the slit clearance of the screen plate 21 is established to be not smaller than 4 mm and the numerical aperture to be 20 to 40 $m^2/T$ (per passing tonnage) considering the mentioned balance in level of material between the two grinding chambers.

With regard to the material of the partition diaphragm 2, any abrasion resistant material such as low alloy steel high chromium cast iron which is difficult to deflect and/or blinding is desirable so as to prevent the corner of the slits from plastic deformation against impact of the ball.

A setting plate 23 on which mounting eyes 22 are provided is superposed on the primary screen plate 21, then a wire sieve 25 having a circular hole 24 with a diameter d larger than a diameter D of the mounting eyes 22 and having a thickness h smaller than a height of the mounting eyes 22 is engagedly inserted in the mounting eyes 22. A connecting chamber 26 is formed between the primary screen plate 21 and the wire sieve 25 as shown in FIG. 2(B), and the shape of this wire sieve and manner of mounting are important for achieving the intended performance.

Figure 1:
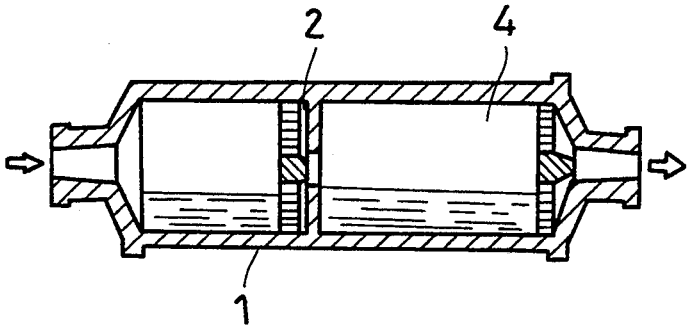
FIG. 1 is a longitudinal sectional view schematically showing an entire arrangement of a compound partition diaphragm for use in a ball mill in accordance with the present invention.
Figure 4:
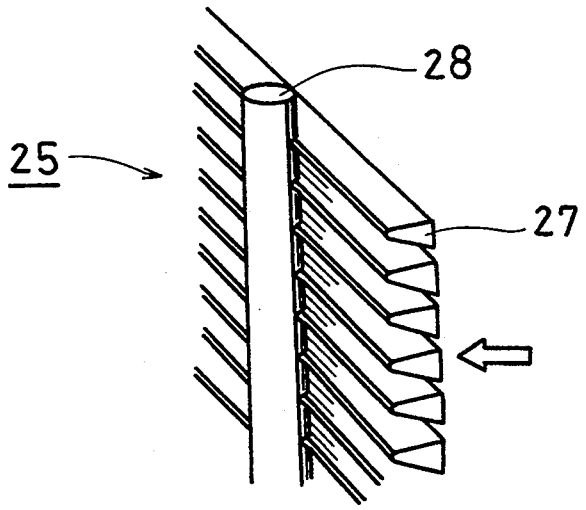
FIG. 4 is a perspective view showing a wire sieve of the embodiment.
Figure 5:
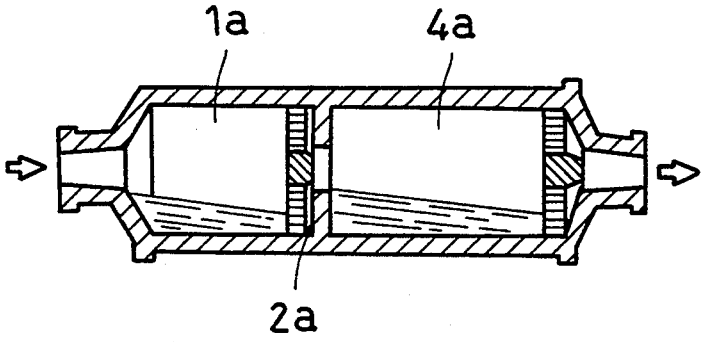
Fig. 5 Prior Art
FIG. 5 is a longitudinal sectional view showing a problem to be solved in the prior art.

FIG. 4 is a perspective view showing an example of the wire sieve 25, which is comprised of wedge wires 27 for regularly opening the slits of trapezoidal shape in section and a supporting rod 28 for collectively supporting the wedge wires 27.

The slit clearance is selected from the range of 2 to 4 mm and regulated so that the level of material is optimum in both chambers. Considering that the slit clearance of the wire sieve is relatively small and easy to be stuck by fine particles of raw material, it is preferable that the wire sieve is made of corrosion resistant material having a smooth surface. In this sense, stainless steel is most recommendable in practical use.

Then a sieve supporter 29 is stretched over the wire sieve 25 so that the entire area of the division is lengthwise and breadthwise covered with meshes of required size, and the sieve supporter 29 is further set by a setting frame 30, thereby the entire wire sieve 25 being loosely accommodated so as to be slightly and freely movable. Furthermore, a supporting plate 31 is applied to form a compartment 32, and finally a blind plate 33 is superposed so as to face the secondary grinding chamber side. All of the mentioned members, i.e., primary screen plate 21, setting plate 23, wire sieve 25, sieve supporter 29, setting frame 30, supporting plate 31 and blind plate 33 are secured by screwing a common bolt 34A through a mounting hole common to all of these members in such a manner that only the wire sieve 25 is slightly movable. In the ball mill of the above contruction, among the material entered from the primary grinding chamber in the connecting chamber 26, the fine particles which have passed through the wire sieve 25 enter in the diaphragm chamber 32, then stirred upward by the rotation of the ball mill, and moved along the blind plate 33 to the center portion of the mill.

In the embodiment shown in FIG. 2, a disc controller 7 provided from the outer peripheral side to the center through the diaphragm chamber 32 is mounted in such a manner as to be freely movable forward and backward with respect to the center core so as to serve as a flow rate regulator. A control disc 71 is mounted on an end of the disc controller 7, thereby the control disc 71 moves forward and backward following the movement of the disc controller 7. Thus a gap formed between the disc controller 7 and the center core is enlarged and reduced and, as a result, the flow rate of a material passing through the gap is regulated. Since the disc controller 7 is branched midway through a connecting bar 72 so as to bend freely, the regulation function is not lost but retained even though the ball mill is deformed during the operation.

Grains of middle size not permitted to pass through the wire sieve 25 after having entered in the connecting chamber 26 are fed back to the primary grinding chamber 1 through the opening of the connecting chamber.

It is to be understood that the present invention is not limited to the foregoing description of the preferred embodiments and various changes and modifications may be made in the invention without departing from the spirit and scope thereof.

What is claimed is:

1. A compound partition diaphragm for use in a ball mill which divides the ball mill into two or more grinding chambers, comprising: a primary screen plate facing a primary grinding chamber; a secondary screen plate mounted adjacent to the primary screen plate; a connecting chamber between the primary screen plate and the secondary screen plate; a common bolt; a setting plate provided with mounting eyes, a wire sieve being provided with circular holes of larger diameter than said mounting eyes and having a thickness smaller than the height of the mounting eye; a sieve supporter which provides the wire sieve with meshes both lengthwise and breadthwise; a supporting plate which supports said wire sieve to be freely movable; and a blind plate, all superposed in order relative to each other from the fan-shaped primary screen plate of each division toward the secondary grinding chamber, and all being secured by said common bolt through a mounting hole which is common to each of said mounting eyes, circular hole, wire sieve, sieve supporter, supporting plate and blind plate, wherein said secondary screen plate comprises a wire sieve provided with a plurality of fine slits each having a trapezoidal shape in section, said wire sieve being disposed loosely so as to be freely movable, and said partition diaphragm being divided circumferentially into several divisions.

2. A compound partition diaphragm for use in a ball mill which divides the ball mill into two or more grinding chambers, comprising: a primary screen plate facing a primary grinding chamber; a secondary screen plate mounted adjacent to the primary screen plate; a connecting chamber between the primary screen plate and the secondary screen plate, said secondary screen plate comprising a wire sieve provided with a plurality of fine slits each having a trapezoidal shape in section, said wire sieve being disposed loosely so as to be freely movable; and means mounting said wire sieve to said primary screen plate such that said wire sieve and said wire sieve mounting means extend in substantially parallel planes and said wire sieve moves in its plane relative to said primary screen plate.

* * * * *